US005095681A

United States Patent [19]

Choi

[11] Patent Number: 5,095,681

[45] Date of Patent: Mar. 17, 1992

[54] FLUID CONTAINER CAPPER APPARATUS

[75] Inventor: Simon Choi, Chicago, Ill.

[73] Assignee: Plant Services Corp., Kenosha, Wis.

[21] Appl. No.: 590,161

[22] Filed: Sep. 28, 1990

[51] Int. Cl.[5] ..... B65B 7/28; B67B 1/04; B67B 3/06

[52] U.S. Cl. ..... 53/306; 53/308; 53/367; 198/394

[58] Field of Search ..... 53/300, 306, 308, 315, 53/319, 328, 367, 202, 310; 198/394

[56] References Cited

U.S. PATENT DOCUMENTS

| | | | |
|---|---|---|---|
| 1,689,815 | 10/1928 | Bunker | 53/300 X |
| 1,748,961 | 3/1930 | Risser | 53/308 X |
| 1,801,728 | 4/1931 | Doble | 221/166 |
| 1,912,677 | 6/1933 | Williams | 53/300 |
| 1,931,943 | 10/1933 | Weaver et al. | 53/300 X |
| 2,082,048 | 6/1937 | Everett | 53/304 |
| 3,054,240 | 9/1962 | Dimond | 53/308 |
| 3,882,660 | 5/1975 | Sterling | 53/367 X |
| 4,098,059 | 7/1978 | Chattillion | 53/367 X |
| 4,280,612 | 7/1981 | Nagano | 198/394 X |
| 4,664,248 | 5/1987 | Goodman, Jr. et al. | 198/394 |
| 4,776,447 | 10/1988 | Pitcher | 198/394 |
| 4,993,537 | 2/1991 | Bianchini et al. | 53/367 X |

*Primary Examiner*—Horace M. Culver
*Attorney, Agent, or Firm*—Dick and Harris

[57] ABSTRACT

An apparatus for mounting caps onto fluid containers in a predetermined particular orientation relative to the fluid containers. Caps are drawn from a source of caps and placed singly, in succession, on a cap seat which is in a particular known orientation. Each cap is taken, while on the cap seat, to a delivery position. During transfer to the delivery position, each cap is aligned into a known particular orientation. A device for picking up the caps takes each cap from the cap seat to a container and mounts the cap onto a waiting fluid container, in the desired predetermined orientation with respect to the fluid container. The device includes an operatively associated clamp that supports the fluid container about a flange around the neck to prevent crushing of the fluid container during mounting of the caps.

22 Claims, 5 Drawing Sheets 11
11
71
72
76
77
78
79
80
81
82
83
85
86
88
21
50
52
53
74

FLUID CONTAINER CAPPER APPARATUS

BACKGROUND OF THE INVENTION

The present invention relates to an apparatus for mounting caps onto fluid containers. In particular, the present invention relates to a device for mounting a cap in a particular predetermined orientation relative to a fluid container and to supporting the fluid container during mounting of the cap.

Apparata which mount caps onto fluid containers, such as containers for liquids, in general are well known. However, in several industries, for example, the bottled water industry, it has become popular to provide bottled water in a container which will also act as a dispenser, in, for example, a household refrigerator. To provide the simplest type of container which will also work as a dispenser, rectangular containers are provided with caps which feature openable and closeable spouts. With such a container set on a side and the spout open, the fluid can leave the container simply propelled by the force of gravity. Accordingly, such containers must be rectangular in cross-section, or at least not round, so that they will not roll about when they are laid on their side.

In order to function properly as a dispenser, the cap and spout must be placed on the container in a particular orientation. Specifically, since the cap, with integral spout, will likely be configured to permit flow from the cap at only one point along the circumference of the cap, the cap must be placed on the container with the opening pointing downward, when the container is laid on one side. In addition, since the fluid containers are often not substantially square, but may be rectangular with, for example, a neck and opening at one end of the top of the container, and with a handle or other feature at the other end of the top of the container, the container must therefore be set on a particular side in order to function as a dispenser. For this reason also it is necessary that the cap be properly aligned when it is mounted onto the container, or failing that, adjusted by hand after mounting.

It is, therefore, desirable to provide a means for mounting the cap onto the fluid container already in the desired orientation for the following additional reasons. Firstly, to align the cap either manually or with other apparatus, after mounting, would tend to slow the operation of the bottling line. In addition, to the extent that the product which is being placed in the containers is a food product or other product which must be delivered to the consumer in a sealed condition, typically the containers are sealed immediately after the caps have been mounted. Accordingly, to either attempt to align the caps after sealing, or introduce an additional step in the capping process for alignment after mounting of the caps, would prove difficult, costly, and time consuming.

It is, accordingly, an object of the present invention to provide an apparatus for mounting caps onto fluid containers, in such a manner that the caps are mounted onto the fluid containers in a previously determined particular desired orientation relative to he fluid container.

A further object of the present invention is to provide an apparatus for aligning caps for fluid containers into a particular pre-determined orientation relative to the fluid containers, prior to the mounting of the caps onto the fluid containers.

Still another object of the invention is to provide an apparatus for mounting caps onto fluid containers which precludes crushing or other undesired loading onto the fluid containers, while the caps are being mounted.

These and other objects of the present invention will become apparent in view of the present Specification, Claims and Drawings.

SUMMARY OF THE INVENTION

The present invention comprises an apparatus for mounting caps onto fluid containers in a particular predetermined orientation relative to the fluid containers. The fluid containers associated with the apparatus each have a neck portion and an opening arranged at an end of the neck portion. The apparatus for mounting caps onto fluid containers in particular comprises a source of caps for the fluid containers, means for transporting each of the caps in succession from the source to a cap drop position, means for seating each of the caps after each of the caps has arrived at the cap drop position, means for transferring the seating means from the cap drop position to a delivery position, means for aligning the caps, one at a time, into a predetermined seated alignment in the seating means, prior to arrival of the seating means at the delivery position, so as to orient the seating means and the caps respectively, into a predetermined position for pick-up and securement of each of the caps onto the neck portion of a corresponding one of the fluid containers, means for moving the fluid containers from a source of the fluid containers, successively, to a capping position, and means for picking up the caps at the delivery position and putting the caps onto the neck portion of the corresponding one of the fluid containers at the capping position to substantially cover the opening of the corresponding one of the fluid containers.

Each of the caps used in association with the apparatus has an asymmetrical lower surface. The holding means comprises a cap seat having an asymmetrical upper seating surface configured thereon to correspond to the asymmetrical lower surface of any one of the caps. Each of the caps is deposited upon the cap seat in succession by the means for transporting the caps when the seating means is in the cap drop position.

Accordingly, the means for picking up and delivering the caps onto the neck portions of the fluid containers at the delivery position comprises a cap pickup member, configured to correspond to the upper surface of each of the caps, so as to grasp the caps, upon pressing of the cap pick-up member upon the caps, in succession, and to release the caps upon pressing of the cap pickup member, and the caps, in succession, onto the neck portions of the fluid containers to substantially cover the openings thereof. Means are provided for raising and lowering the cap pick-up member, as well as means for shifting the cap pick-up member and the means for raising and lowering the cap pick-up member between the delivery position and the capping position.

The aligning means comprise means for rotating the cap seat and means for precluding rotation of each of the caps until the asymmetrical upper seating surface of the cap seat and the asymmetrical lower surface of each of the caps are aligned.

The means for precluding rotation of each of the caps comprises a guide member which is biased downwardly to press each of the caps against the cap seat to produce frictional forces between the caps and the guide member for preventing rotation of the caps while the rotating means rotate until the asymmetrical upper seating surface and the asymmetrical lower surface of each of the caps achieve the predetermined seated alignment.

In a preferred embodiment of the invention, the rotating means comprise a pinion operably arranged for rotation with the cap seat and a rack operably arranged for movement transversely to the axis of rotation of the pinion, to engage the pinion, and cause rotation of the cap seat.

The rotating means further comprise the pinion and the cap seat being mounted for rotation about a common axis of rotation.

In addition, the apparatus further comprises means for supporting the fluid containers as they arrive at the capping position, so as to preclude crushing of the fluid containers while the caps are put onto the neck portions of the corresponding fluid containers.

The means for supporting the fluid containers comprises means for grasping the containers about the neck portions thereof, operably associated with the cap pick-up means after each of the fluid containers is moved to the capping position, to enable putting the caps onto the openings of the fluid containers while precluding loading of undesired stresses upon the fluid containers.

The neck portion of each of the fluid containers preferably is substantially cylindrical and includes at least one flange, which extends radially outward therefrom so that the flange is spaced from the opening. Accordingly, the means for grasping the containers about the neck portion, in a preferred embodiment, comprises at least one pair of jaws configured to close about the neck portion of the corresponding one of the fluid containers under the at least one flange, simultaneously with the pressing of one of caps onto the neck portion of the corresponding one of the fluid containers. Each of the jaws includes a projecting rim having an arcuate concave inner edge, so that when the jaws close upon the neck portion, the neck portion is uniformly and tightly gripped about its circumference.

The invention also includes an apparatus for mounting caps onto fluid containers, with the fluid containers each having a neck portion and an opening arranged at an end of the neck portion. The apparatus for mounting caps onto fluid containers comprises means for grasping and pressing each of the caps onto corresponding ones of the fluid containers and means for supporting the fluid containers as the caps are pressed on to the corresponding ones of the fluid containers so as to preclude crushing of the fluid containers while each of the caps is put onto the neck portion thereof.

The means for supporting the fluid containers comprises means for gripping the containers about the neck portions thereof, operably associated with the means for grasping and pressing the caps, to enable pressing the caps onto the openings of the fluid containers while precluding loading of undesired stresses upon the fluid containers. Each neck portion on the fluid containers is preferably substantially cylindrical and includes at least one flange, which extends radially outward from the neck portion. The at least one flange is spaced from the opening. At least one pair of jaws is configured to close under the at least one flange simultaneously with the pressing of one of the caps onto the neck portion of the corresponding one of the fluid containers so that the jaws engage the flange for support of the fluid containers. The at least one pair of jaws is configured to close about the neck portion of the corresponding one of the fluid containers. Each jaw includes an inwardly projecting rim having an arcuate concave inner edge, so when the jaws close upon the neck portion, the neck portion is substantially uniformly and tightly gripped about its circumference.

DETAILED DESCRIPTION OF THE DRAWINGS

Figure 1:
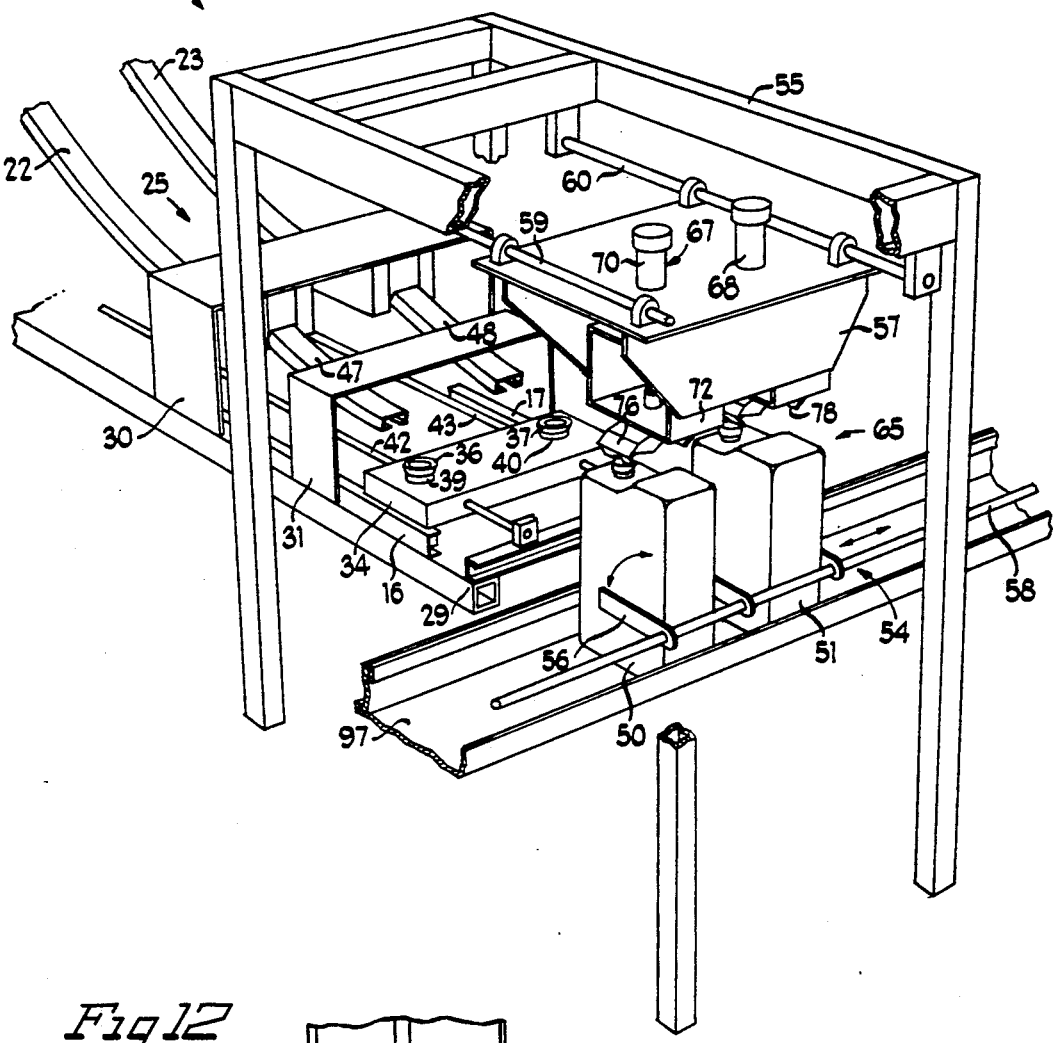
FIG. 1 is a left side perspective view of the fluid container capper apparatus according to the preferred embodiment of the invention.
Figure 12:
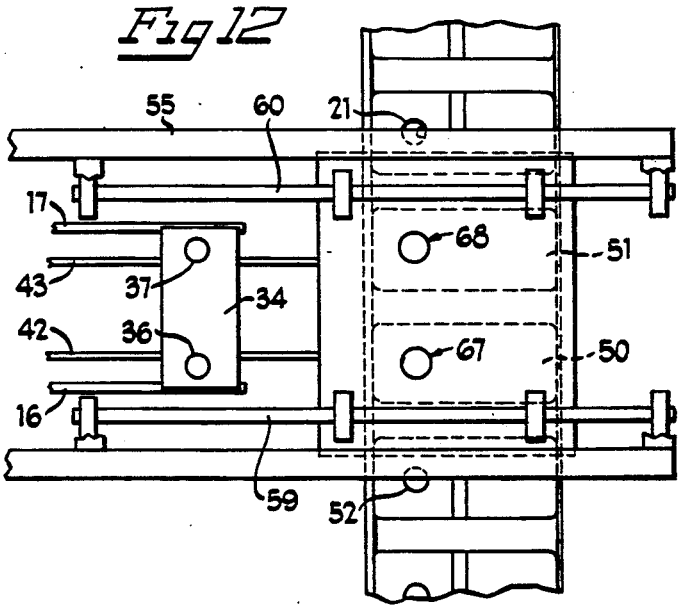
FIG. 12 is a top plan view of a portion of the capper apparatus according to FIG. 1.
Figure 2:
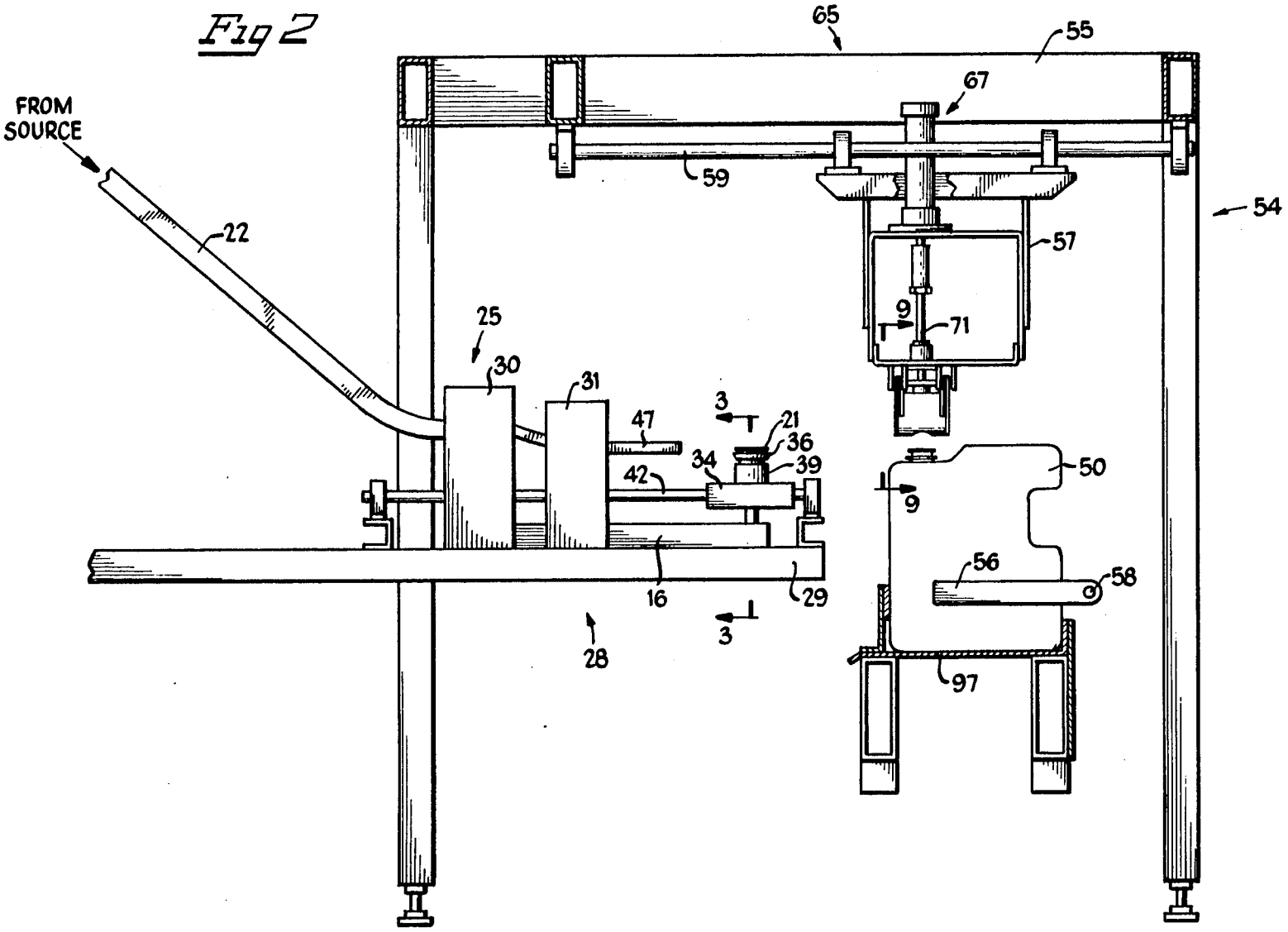
FIG. 2 is a left side elevation of the capper apparatus according to FIG. 1.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Figure 7:
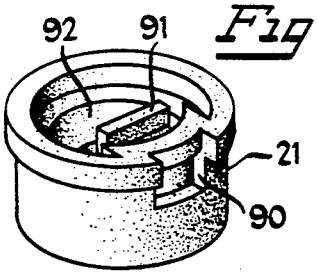
FIG. 7 is a top perspective view of a cap used in association with the preferred embodiments of the invention.
Figure 8:
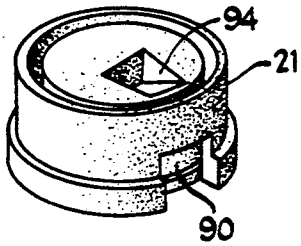
FIG. 8 is a bottom perspective view of the cap according to FIG. 7.

Fluid container capper apparatus 20, is seen in perspective in FIG. 1. Capper apparatus 20 includes a source of caps (not shown) which may be a conventional spiral unloading hopper or similar device. Capper apparatus 20, as disclosed in FIG. 1, is configured for capping two containers at a time; the invention, however, may be applied for capping from one container at a time to any number simultaneously. Caps, such as cap 21, shown in FIGS. 7 and 8, are delivered from the source along guides 22 and 23, which terminate at cap drop position 25, which is located within the alignment portion 28 of capper apparatus 20.

Alignment portion 28 includes supports 30 and 31, carriage block 34, and cap seats 36 and 37, which are formed as the upper portions of rotors 39 and 40, respectively. Carriage block 34 is mounted for movement between cap drop position 25 and delivery position 45, along rails 42 and 43. Carriage block 34 may be propelled back and forth along rails 42 and 43, by any suitable means, such as a ball screw device, or a horizontally moving piston. Pressure bars 47 and 48, which are suspended from supports 30 and 31, help hold the caps 21 down into cap seats 36 and 37 as described hereinafter.

Figure 6:
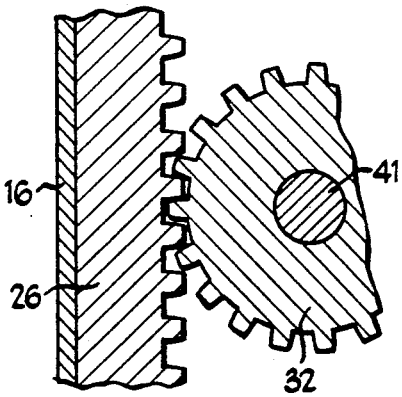
FIG. 6 is a top plan view, in section, of the rack and pinion taken generally along line 6—6 of FIG. 3.

Extending parallel to, and to the outside of, rails 42 and 43, are rack supports 16 and 17, respectively. Extending along the inside of each of rack supports 16 and 17 is a rack, such as rack 26 shown in FIGS. 3 and 6. Rails 42 and 43 are supported by cap drop frame 29.

Containers such as 50 and 51 are brought to capping position 65 along track 97. Any suitable means of propulsion may be used. For example, track 97 may, itself, comprise a conveyer belt. Alternatively, a shuttle system 54, comprising a plurality of spaced paddles 56, mounted on an axially reciprocating, rotatable shaft 58, may be employed, to move containers 50, 51, etc. along track 97 incrementally. In particular, when paddles 56 are in the horizontal position shown in FIG. 1, shaft 58 is shifted to the left, moving containers 50, 51 into capping position 65. Once capping has been accomplished, shaft 5B rotates paddles 56 up to a vertical position (not shown), and shifts back to the right (as seen in FIG. 1), to bring the next two containers into the capping position 65.

The operation of alignment portion 28 can be seen from FIGS. 3–8. Only the left hand side of capper apparatus 20, as seen in FIG. 1, is shown in the FIGS. 3–6 and described herein, the operation of the right side of apparatus 20 being substantially identical. Each cap 21, as seen in FIGS. 7 and 8, is substantially cylindrical in shape. However, each cap 21 has an asymmetrical lower surface. In particular, each cap 21 includes an opening slot 90, which is provided to permit the dispensing of fluid from a container, after cap 21 has been placed onto a container.

Opening slot 90 is ordinarily sealed off by the neck of the container. However, when tab 91 of cap 20, which projects outwardly from recessed interior 92 of the upper surface of cap 21, is pressed transversely away from opening slot 90, as indicated by the arrow in FIG. 7, a portion of the recessed interior of cap 21, adjacent slot 90, is distended away from the inner surface of the opening of the container to enable fluid to pass through opening slot 90. Likewise, the lower surface of cap 90 is seen in FIG. 8, to be asymmetrical, in that recess 94 is provided. Recess 94 is advantageously formed in the "backside" of tab 91. The asymmetrical nature of the lower surface of cap 21 permits the cap to be rotationally aligned, for purposes of positioning on the neck of a waiting container.

Figure 3:
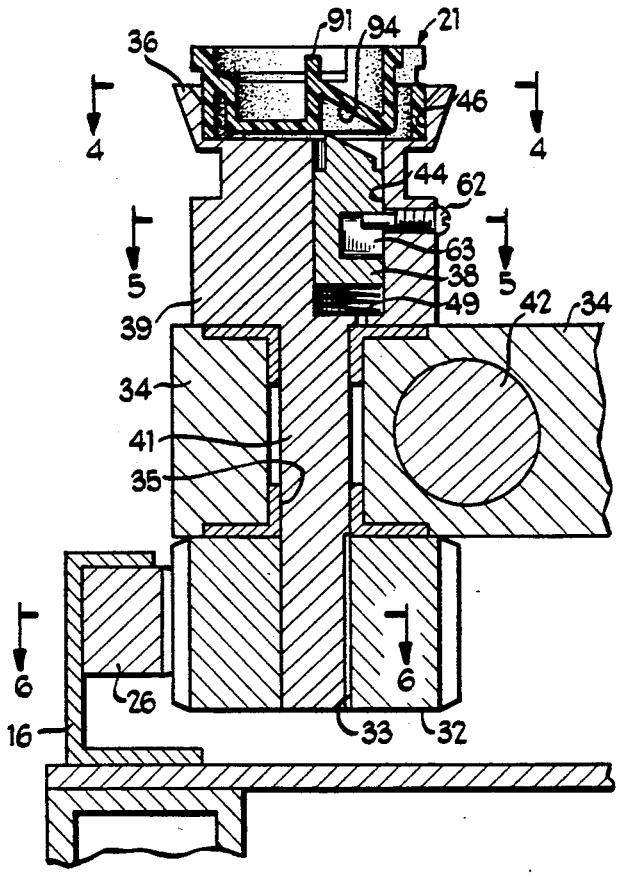
FIG. 3, is a front elevation in section of the cap seat and rotor mounted on the carriage block, in section, generally taken along line 3—3 of FIG. 2.
Figure 4:
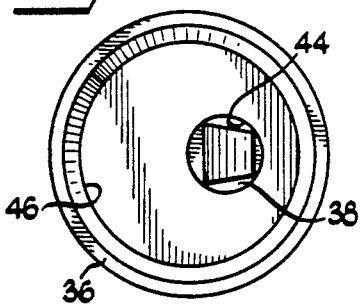
FIG. 4 is a top plan view in section of the cap seat taken generally along line 4—4 of FIG. 3.
Figure 5:
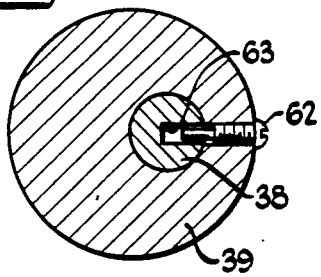
FIG. 5 is a top plan view in section of the rotor taken generally along line 5—5 of FIG. 3.

FIG. 3 shows cap seat 36, which is integrally formed atop rotor 39. Projecting from the lower side of rotor 39 is rotor shaft 41, which extends through carriage block 34, in shaft bore 35. Rotor shaft 41 is coaxial with rotor 39 and cap seat 36. Pinion 32 is mounted on the end of rotor shaft 41, coaxial with rotor shaft 41, and is keyed to rotor shaft 41, by shaft key 33, for rotation with rotor shaft 35.

The seating of a cap proceeds as follows. As cap 21 arrives at cap drop position 25, carriage block 34 is waiting. Cap 21 lands on cap seat 36 in a random angular orientation with respect to the cap seat. As seen in FIG. 3, cap seat 36 and rotor 39 are integrally formed, with bore 44 extending through rotor 39, and cap seat 36, opening onto recess 46 of cap seat 36. Plunger 38 is arranged for sliding vertical movement in bore 44. Spring 49 tends to force plunger 38 upward; however, screw 62, which extends into notch 63 of plunger 38, limits the range of movement of plunger 38. The top of plunger 38 is configured to fit closely within recess 94 of cap 21, when cap 21 is properly aligned in cap seat 36.

Ordinarily, cap 21 will not drop from guide 22, into cap seat 36, in the correctly aligned orientation. Accordingly, plunger 38 will be struck and tend to be pushed down by the flat bottom portion of cap 21 with the aid of pressure bar 47. The movement of carriage block 34 is controlled so as to proceed toward delivery position 45 immediately once cap 21 has dropped into cap seat 36. As carriage block 34 moves to delivery position 45, pressure bar 47 ensures that cap 21 stays pressed into cap seat 36. In addition, rotor 39 begins to rotate, as pinion 32 rolls along rack 26. Pressure bar 47 additionally prevents cap 21 from rotating with rotor 39 and cap seat 36.

Rack 26 is advantageously configured long enough to ensure that rotor 39 and cap seat 36 undergo more than one full rotation, so that cap 21 will, by necessity, become aligned with plunger 38. At that point, plunger 38 will rise up to fit in recess 94, and cause cap 21 to overcome the friction of pressure bar 47 and rotate with cap seat 36. With cap 21 aligned as shown in FIG. 3, plunger 38 should have entered recess 94; however, for ease of illustration, plunger 38 is still shown in the retracted position that it was in prior to cap 21 becoming aligned. Also, the length of rack 26, and orientation of rotor 39 relative to rack 26, ensure that when carriage block 34 arrives at delivery position 45, cap seat 36 and therefore cap 21, are placed in the desired orientation relative to container 50, which has been brought to capping position 65.

Once cap 21, in cap seat 36, has been delivered to delivery position 45, in its proper desired alignment and orientation, cap 21 is then picked up and placed onto a fluid container 50 by cap mounting assembly 54. Frame work 55 supports capping carriage 57, which is supported on rails 59 and 60, for movement back and forth between delivery position 45 and capping position 65. Capping carriage 57 supports capper assemblies 67 and 68, which operate in substantially identical manner.

Capper assembly 67 includes piston 70 which is configured to reciprocate shaft 71 within capper frame 72. Mounted at the bottom of shaft 71 is cap holder 74 which receives cap 21 in the desired aligned orientation and retains it by frictional engagement. Jaws 76 and 77 are suspended from capper frame 72 on supports 80, and 81, respectively, for rotation about pins 82 and 83 respectively. Jaws 76 and 77 have configured, in each side thereof, curved slots 85 and 86, respectively. Pin 88 extends transversely through cap holder 74 and projects laterally through both of slots 85 and 86, on both sides of jaws 76 and 77.

When carriage block 34 is in delivery position 45, capping carriage 57, which reciprocates between delivery position 45 and capping position 65, also is at delivery position 45. Piston 70, for example, descends toward cap seat 36, pressing cap holder 74 down onto ca 21. The undersurface of cap holder 74 has a cylindrical recess configured to frictionally grasp the top of cap 21. Jaws 71 and 77 close about the sides of rotor 39, in a similar manner as described with respect to the capping operation, so rotor 39 should have a diameter equal to or less than the diameter of the necks of the containers to be capped. Piston 70 then rises, cap holder 74 lifting cap 21 off of cap seat 36. Capping carriage 57 moves to capping position 65, either during or after the raising of piston 70.

Figures 9, 10, 11:
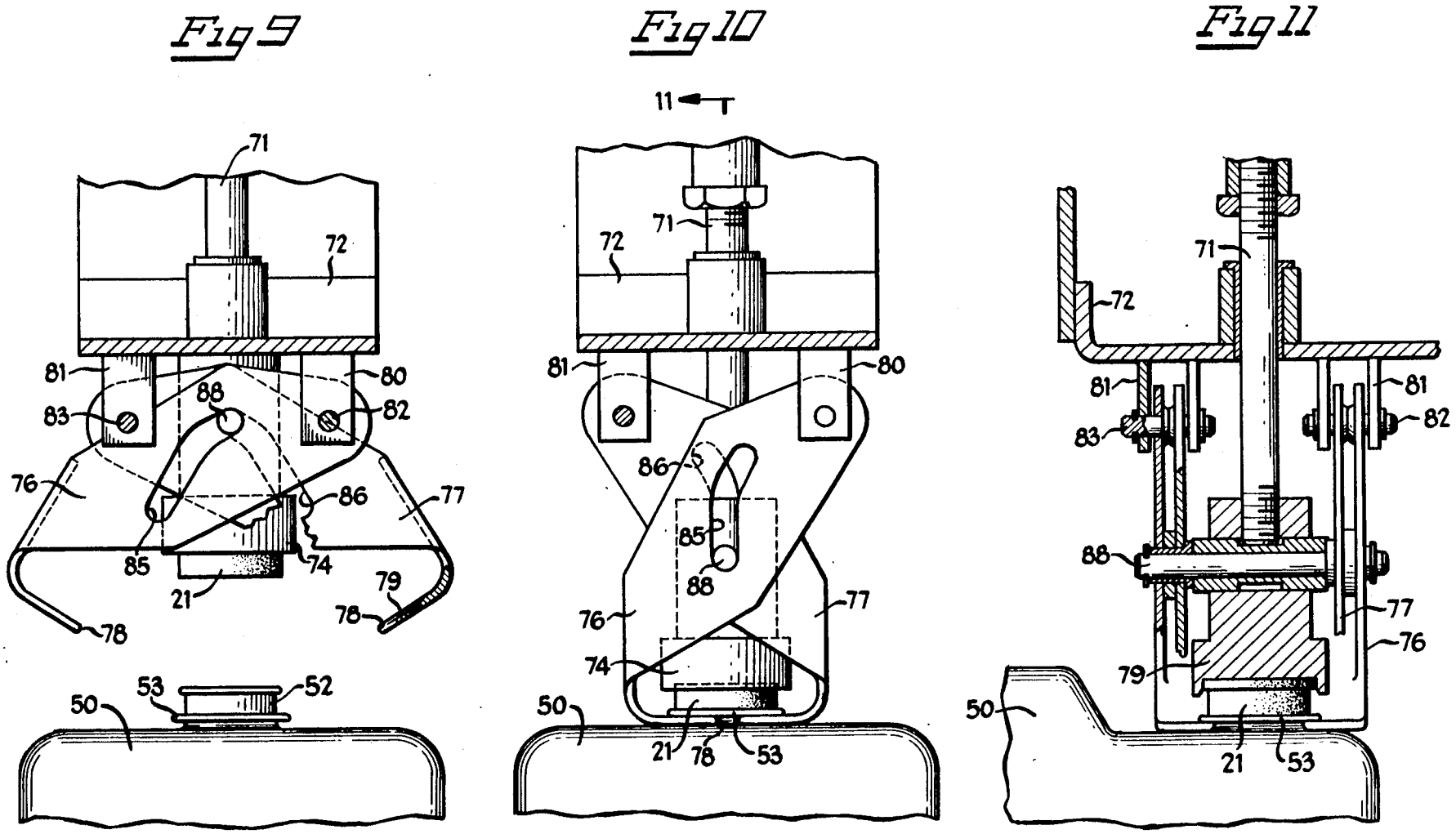
FIG. 9 is a front elevation of the cap holder and jaws for supporting the container, shown at the upper portion of the stroke of the cap holders.
FIG. 10 is a front side elevation of the cap holder and jaws for supporting the container shown in the lower end of the stroke of the cap holder, with the jaws closed about the neck of the neck portion of the container.
FIG. 11 is a side elevation, partly in section, of the cap holder and jaws for supporting the container, according to FIG. 10.

As seen in FIGS. 9–11, when piston 70 moves downward, driving shaft 71 and cap holder 74 toward container 50, in order to place cap 21 onto neck 52 of container 50, and cap holder 74 moves downward, pin 88 moves downward with respect to each of slots 85 and 86. Since pin 88 cannot move with respect to cap holder 74, jaws 76 and 77 are constrained, through the movement of pin 88 along slots 85 and 86, simultaneously, to rotate, about pins 83 and 82, respectively, towards each other. As cap holder 74 approaches neck 52, jaws 76 and 77 first close around neck 52, under flange 53. As can be seen in the FIGS. 9 and 10, each of slots 85 and 86 are provided with a lower substantially straight portion, which ensures that jaws 76 and 77 reach their maximum rotation toward each other, before shaft 71 reaches the bottom of its stroke. Each of jaws 76 and 77 include an inwardly projecting rim 78 having an arcuate concave inner edge 79 that substantially conforms to the arcuate periphery of neck 52 under flange 53. By having jaws 76 and 77 close around neck 52 of container 50, under flange 53, as cap holder 74 presses downward upon neck 52, the force which is exerted by cap holder 74 onto container 50 is transmitted through neck 52 and flange 53 into jaws 76 and 77, so as to prevent crushing or other undesired loading on the remainder of container 50. Once cap 21 is pressed on neck 52 by piston 70, the frictional engagement between cap 21 and neck 22 is greater than the frictional engagement between cap 21 and cap holder 74 so that cap 21 is released from cap holder 74 upon retraction of piston 72. As piston 72 retracts, jaws 76 and 77 open to release the neck of the container.

The capping apparatus 20 of FIGS. 1–12 is shown using a straight line container shuttle, in which the containers are filled by a filling device (not shown) to one side of the capping apparatus. However, the same principles may also be applied to a rotary container filling apparatus, as shown in FIGS. 13 and 14.

Figure 13:
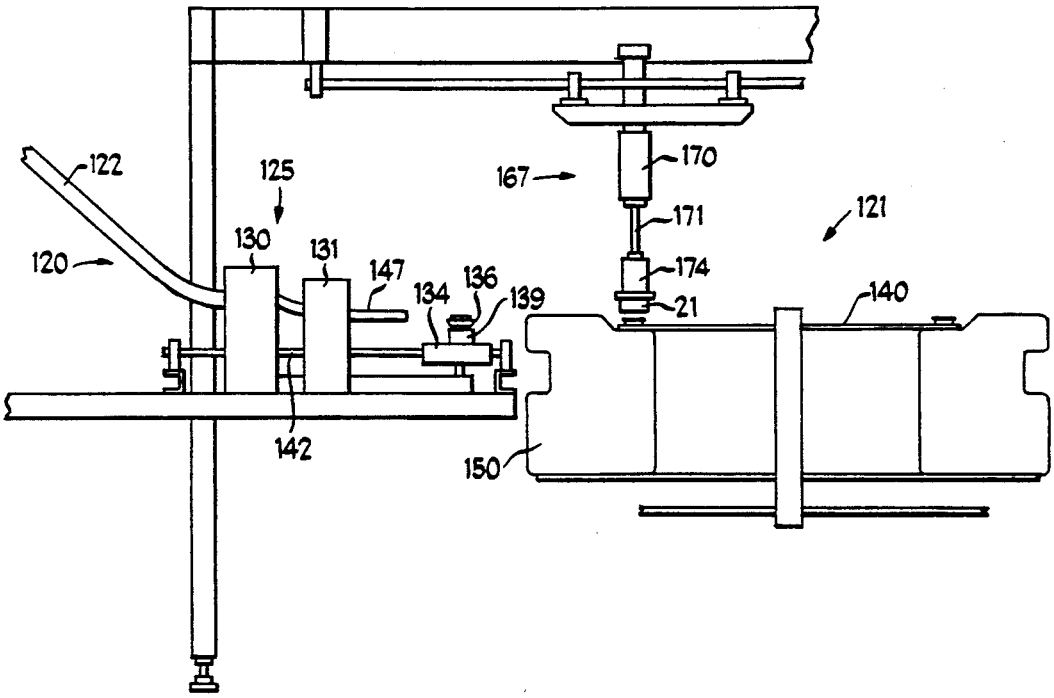
FIG. 13 is a left side elevation of an alternative preferred embodiment of the invention.
Figure 14:
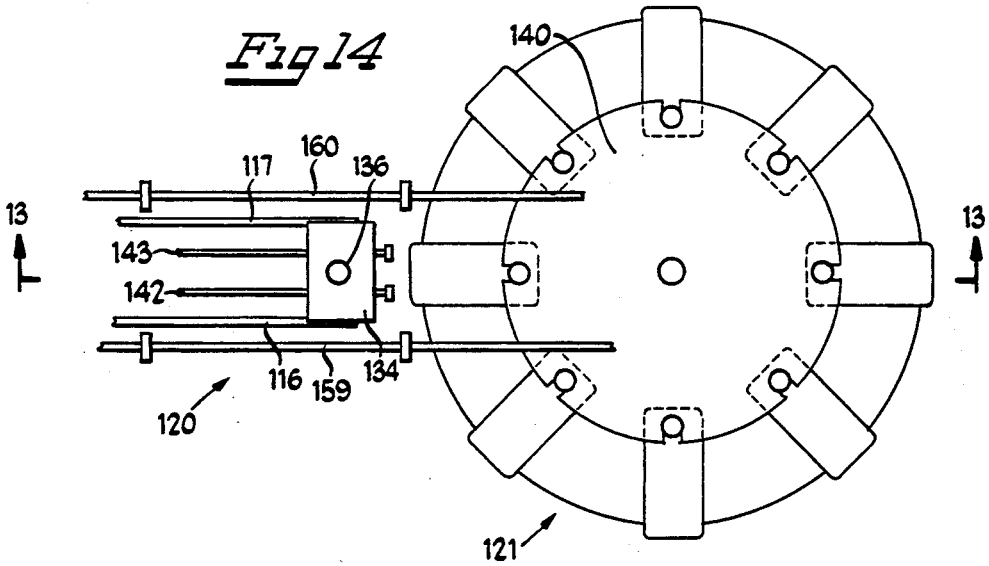
FIG. 14 is a top plan view of the capper apparatus according to FIG. 13.

FIG. 13 shows capper apparatus 120, associated with a rotary container filling device 121. The nozzles and related attachments have been omitted from the drawings for ease of illustration. Capper apparatus 120 is configured for delivering and mounting only a single cap at a time. Capper apparatus 120 includes guide 122, supports 130, 131, cap drop position 125, rail 142, pressure bar 147, carriage block 134, rotor 139, cap seat 136. However, capper assembly 167 includes only piston 170, shaft 171, and cap holder 174. As is typical with rotary container filling devices, containers 150, 151, held in place on a rotary carrier 140, are already supported about the neck portion, and no jaws are necessary, though they may be provided if desired, as are in the previously discussed embodiment. Aside from this distinction, the operation of capper apparatus 120 is substantially identical to that of capper apparatus 20.

The foregoing description and drawings merely explain and illustrate the invention and the invention is not limited thereto except insofar as the appending claims are so limited, as those skilled in the art who have the disclosure before them will be able to make modifications in variations therein without departing from the scope of the invention.

What is claimed is:

1. An apparatus for mounting caps onto fluid containers in a particular predetermined orientation relative to said fluid containers, said containers each having a neck portion and an opening arranged at an end of said neck portion, said apparatus for mounting caps onto fluid containers comprising:

a source of caps for said fluid containers;

means for transporting each of said caps in succession from said source to a cap drop position, said caps arriving at said cap drop position in random relative orientation between successive caps;

means for seating each of said caps after each of said caps has arrived at said cap drop position;

means for transferring said seating means from said cap drop position to a delivery position;

means for aligning said caps, one at a time, from said random relative orientation, into a predetermined seated alignment in said seating means, prior to arrival of said seating means at said delivery position, so as to orient said seating means and said caps, respectively, into a predetermined position for pick-up and securement of each of said caps onto said neck portion of a corresponding one of said fluid containers;

means for moving said fluid containers from a source of said fluid containers, successively, to a capping position; and means for picking up said caps at said delivery position and positioning said caps onto said neck portions of said corresponding fluid containers at said capping position to substantially cover the openings of said corresponding fluid containers.

2. The apparatus for mounting caps onto fluid containers according to claim 1, wherein each of said caps has an asymmetrical lower surface and wherein said seating means further comprises:

a cap seat member, having an asymmetrical upper seating surface configured thereon to correspond to said asymmetrical lower surface of any one of said caps, each of said caps being deposited upon said cap seat member in succession by said means for transporting said caps when said seating means is in said cap drop position.

3. The apparatus for mounting caps onto fluid containers, according to claim 2, wherein said means for picking up and putting said caps onto said neck portions at said delivery position and securing said caps comprises:

a cap pick-up member, configured to correspond to said upper surface of each of said caps, so as to grasp said caps, upon pressing of said cap pick-up member upon said caps, in succession, and to release said caps upon pressing of said cap pick-up member, and said caps, in succession, onto the neck portion of each of said fluid containers to substantially cover the opening;

means for raising and lowering said cap pick-up member;

means for shifting said cap pick-up member and said means for raising and lowering said cap pick-up member between said delivery position and said capping position.

4. The apparatus for mounting caps onto fluid containers according to claim 2, wherein said aligning means comprises:

means for rotating said cap seat member; and means for precluding rotation of each of said caps until said asymmetrical upper seating surface of said cap seat member and said asymmetrical lower surface of said each of said caps are aligned, said means for precluding rotation of each of said caps thereupon forcing said caps downward into said predetermined seated alignment.

5. The apparatus for mounting caps onto fluid containers according to claim 4, wherein said means for precluding rotation of each of said caps comprises:

a guide member, biased downwardly to press each of said caps against said cap seat member to produce frictional forces between said caps while said rotating means rotates, until said asymmetrical upper seating surface and said asymmetrical lower surface of each of said caps achieve said predetermined seated alignment.

6. The apparatus for mounting caps onto fluid containers, according to claim 4, wherein said rotating means comprises:

a pinion operably arranged for rotation with said cap seat member; and a rack operably arranged for movement transversely to an axis of rotation, to engage said pinion, and cause rotation of said cap seat member.

7. The apparatus for mounting caps onto fluid containers, according to claim 6, wherein said rotating means further comprises:

said pinion and said cap seat member mounted for rotation about a common axis of rotation.

8. The apparatus for mounting caps onto fluid containers according to claim 1, wherein said apparatus further comprises:

means for supporting said fluid containers as said fluid containers arrive at said capping position, so as to preclude crushing of said fluid containers while each of said caps is put onto said neck portion of said corresponding one of said fluid containers.

9. The apparatus for mounting caps onto fluid containers according to claim 8, wherein said means for supporting said fluid containers comprises:

means for grasping said containers about the neck portion thereof, operably associated with said cap pick-up means after said corresponding one of said fluid containers is moved to said capping position, to enable putting said caps onto said openings of said fluid containers while precluding loading of undesired stresses upon said fluid containers.

10. The apparatus for mounting caps onto fluid containers according to claim 9, wherein each neck portion on each of said fluid containers is substantially cylindrical and includes at least one flange, extending radially outward therefrom, said at least one flange being spaced from said opening, and wherein said means for grasping said containers about the neck portion thereof comprises:

at least one pair of jaws configured to close about the neck portion of said corresponding one of said fluid containers, below said at least one flange, simultaneously with the pressing of one of said caps onto the neck portion of said corresponding one of said fluid containers, and each of said jaws includes an inwardly projecting rim having an arcuate concave inner edge, so that when said jaws close upon said neck portion, said neck portion is uniformly and tightly gripped about its circumference.

11. An apparatus for orienting caps to be secured upon fluid containers in a predetermined orientation relative to said fluid containers, prior to placement and securement of said caps onto said fluid containers, said fluid containers each having a neck portion and an opening arranged at an end of said neck portion, each of said caps being delivered to said apparatus for orienting caps from a source of said caps to a cap drop position, said caps arriving at said cap drop position in relative random orientation between successive caps, said apparatus for orienting caps comprising:

means for seating each of said caps after each of said caps has arrived at said cap drop position;

means for transferring each of said seating means from said cap drop position to a delivery position;

means for aligning each of said caps from said random relative orientation into a predetermined seated alignment in said seating means, prior to arrival of said seating means at said delivery position, so as to place said seating means and said caps, respectively, into a predetermined position for said placement and securement onto said fluid containers.

12. The apparatus for orienting caps according to claim 11, wherein each of said caps has an asymmetrical lower surface and wherein said seating means further comprises:

a cap seat member, having an asymmetrical upper seating surface configured thereon to correspond to said asymmetrical lower surface of said caps, said caps being deposited upon said cap seat member when said seating means is in said cap drop position.

13. The apparatus for orienting caps according to claim 12, wherein said aligning means comprises:

means for rotating said cap seat member; and means for precluding rotation of said caps until said asymmetrical upper seating surface of said cap seat member and said asymmetrical lower surface of said caps are aligned, said means for precluding rotation of said caps thereupon forcing said caps downward into said predetermined seated alignment.

14. The apparatus for orienting caps according to claim 13, wherein said means for precluding rotation of said caps comprises:

a guide member, biased downwardly to press each of said caps against said cap seat member to produce frictional forces between said caps and said guide member for preventing rotation of said caps while said rotating means rotates, until said asymmetrical upper seating surface and said asymmetrical lower surface of said caps achieve said predetermined seated alignment.

15. The apparatus for orienting caps according to claim 13, wherein said means for rotating said cap seat member comprises:

a pinion operably arranged for rotation with said seat member; and a rack operably arranged for movement transversely to an axis of rotation, to engage said pinion, and cause rotation of said cap seat member.

16. The apparatus for orienting caps according to claim 15, wherein said means for rotating said cap seat member comprises:

said pinion and said cap seat member mounted for rotation about a common axis of rotation.

17. An apparatus for mounting caps, having asymmetrical lower surfaces, onto fluid containers in a particular predetermined orientation relative to said fluid containers, said containers each having a neck portion and an opening arranged at an end of said neck portion, said apparatus for mounting caps onto fluid containers comprising:

a source of caps for said fluid containers;

means for transporting each of said caps in succession from said source to a cap drop position;

a cap seat member, having an asymmetrical upper seating surface configured thereon to correspond to said asymmetrical lower surface of any one of said caps, each of said caps being deposited upon said cap seat member in succession by said means for transporting said caps when said seating means is in said cap drop position;

means for transferring said cap seat member from said cap drop position to a delivery position;

means for rotating said cap seat member;

a guide member, biased downwardly to press each of said caps against said cap seat member to produce frictional forces between said caps while said rotating means rotates, until said asymmetrical upper seating surface and said asymmetrical lower surface of each of said caps are aligned, forcing said caps downward into said cap seat member, for aligning said caps, one at a time, into a predetermined seated alignment in said cap seat member, prior to arrival of said cap seat member at said delivery position, so as to orient said cap seat member and said caps, respectively, into a predetermined position for pick-up and securement of each of said caps onto said neck portion of a corresponding one of said fluid containers;

means for moving said fluid containers form a source of said fluid containers, successively, to a capping position; and means for picking up said caps at said delivery position and positioning said caps onto said neck portions of said corresponding fluid containers at said capping position to substantially cover the openings of said corresponding fluid containers.

18. An apparatus for mounting caps, having asymmetrical lower surfaces, onto fluid containers in a particular predetermined orientation relative to said fluid containers, said containers each having a neck portion and an opening arranged at an end of said neck portion, said apparatus for mounting caps onto fluid containers comprising:

a source of caps for said fluid containers;

means for transporting each of said caps in succession from said source to a cap drop position;

a cap seat member, having an asymmetrical upper seating surface configured thereon to correspond to said asymmetrical lower surface of any one of said caps, each of said caps being deposited upon said cap seat member in succession by said means for transporting said caps when said seating means is in said cap drop position;

means for transferring said cap seat member from said cap drop position to a delivery position;

a pinion operably arranged for rotation, with said cap seat member, about an axis of rotation;

a rack operably arranged for movement transversely to said axis of rotation of said pinion, to engage said pinion, and cause rotation of said cap seat member;

means for precluding rotation of each of said caps until said asymmetrical upper seating surface of said cap seat member and said asymmetrical lower surface of said each of said caps are aligned, said means for precluding rotation of each of said caps thereupon forcing said caps downward for aligning said caps, one at a time, into a predetermined seated alignment in said cap seat member, prior to arrival of said cap seat member at said delivery position, so as to orient said cap seat member and said caps, respectively, into a predetermined position for pick-up and securement of each of said caps onto said neck portion of a corresponding one of said fluid containers;

means for moving said fluid containers from a source of said fluid containers, successively, to a capping position; and means for picking up said caps at said delivery position and positioning said caps onto said neck portions of said corresponding fluid containers at said capping position to substantially cover the openings of said corresponding fluid containers.

19. The apparatus for mounting caps onto fluid containers, according to claim 18, wherein said pinion and said cap seat member are mounted for rotation about a common axis of rotation.

20. An apparatus for orienting caps, having asymmetrical lower surfaces, to be secured upon fluid containers in a predetermined orientation relative to said fluid containers, prior to placement and securement of said caps onto said fluid containers, said fluid containers each having a neck portion and an opening arranged at an end of said neck portion, each of said caps being delivered to said apparatus for orienting caps from a source of said caps to a cap drop position, said apparatus for orienting caps comprising:

a cap seat member, having an asymmetrical upper seating surface configured thereon to correspond to said asymmetrical lower surface of said caps, said caps being deposited upon said cap seat member when said seating means is in said cap drop position;

means for transferring each of said seating means from said cap drop position to a delivery position;

means for rotating said cap seat member;

a guide member, biased downwardly to press each of said caps against said cap seat member to produce frictional forces between said caps and said guide member for preventing rotation of said caps while said rotating means rotates, until said asymmetrical upper seating surface and said asymmetrical lower surface of said caps achieve a predetermined seated alignment;

means for aligning each of said caps into a predetermined seated alignment in said seating means, prior to arrival of said seating means at said delivery position, so as to place said seating means and said caps, respectively, into a predetermined position for said placement and securement onto said fluid containers.

21. An apparatus for orienting caps, having asymmetrical lower surfaces, to be secured upon fluid containers in a predetermined orientation relative to said fluid containers, prior to placement and securement of said caps onto said fluid containers, said fluid containers each having a neck portion and an opening arranged at an end of said neck portion, each of said caps being delivered to said apparatus for orienting caps from a source of said caps to a cap drop position, said apparatus for orienting caps comprising:

a cap seat member, having an asymmetrical upper seating surface configured thereon to correspond to said asymmetrical lower surface of said caps, said caps being deposited upon said cap seat member when said seating means is in said cap drop position;

means for transferring each of said seating means from said cap drop position to a delivery position;

a pinion operably arranged for rotation with said cap seat member;

a rack operably arranged for movement transversely to the axis of rotation of said pinion, to engage said pinion, and cause rotation of said cap seat member;

means for precluding rotation of said caps until said asymmetrical upper seating surface of said cap seat member and said asymmetrical lower surface of said caps are aligned, said means for precluding rotation of said caps thereupon forcing said caps downward into said predetermined seated alignment;

means for aligning each of said caps into a predetermined seated alignment in said seating means, prior to arrival of said seating means at said delivery position, so as to place said seating means and said caps, respectively, into a predetermined position for said placement and securement onto said fluid containers.

22. The apparatus for orienting caps according to claim 21, wherein said pinion and said cap seat member are mounted for rotation about a common axis of rotation.

* * * * *

UNITED STATES PATENT AND TRADEMARK OFFICE

CERTIFICATE OF CORRECTION

PATENT NO. : 5,095,681

DATED : March 17, 1992

INVENTOR(S) : Simon Choi

It is certified that error appears in the above-identified patent and that said Letters Patent is hereby corrected as shown below:

| | |
|---|---|
| Col. 1, Line 62 | Delete "relative to he fluid" and instead insert --relative to the fluid--. |
| Col. 6, Line 63 | Delete "down onto ca 21." and instead insert --down onto cap 21.--. |

Signed and Sealed this

Twenty-ninth Day of June, 1993

*Attest:*

*Attesting Officer*

Michael K. Kirk

MICHAEL K. KIRK

*Acting Commissioner of Patents and Trademarks*